US006056054A

United States Patent [19]

Brady et al.

[11] Patent Number: 6,056,054

[45] **Date of Patent: *May 2, 2000**

[54] METHOD AND SYSTEM FOR SEPARATING AND INJECTING WATER IN A WELLBORE

[75] Inventors: Jerry L. Brady; Mark D. Stevenson; John M. Klein; James L. Cawvey, all of Anchorage, Ak.

[73] Assignee: Atlantic Richfield Company, Los Angeles, Calif.

[ * ] Notice: This patent is subject to a terminal disclaimer.

[21] Appl. No.: 09/016,612

[22] Filed: Jan. 30, 1998

[51] Int. Cl.[7] ..... E21B 43/38; E21B 43/40

[52] U.S. Cl. ..... 166/265; 166/105.5

[58] Field of Search ..... 166/105, 265, 166/105.5, 105.6, 306

[56] References Cited

U.S. PATENT DOCUMENTS

| | | | |
|---|---|---|---|
| 4,378,047 | 3/1983 | Elliott et al. | 166/68 |
| 4,531,584 | 7/1985 | Ward | 166/265 |
| 4,531,593 | 7/1985 | Elliott et al. | 175/71 |
| 4,610,793 | 9/1986 | Miller | 210/767 |
| 4,981,175 | 1/1991 | Powers | 166/265 |
| 4,995,456 | 2/1991 | Cornette et al. | 166/51 |
| 5,343,945 | 9/1994 | Weingarten et al. | 166/105.5 |
| 5,385,446 | 1/1995 | Hays | 415/202 |
| 5,425,416 | 6/1995 | Hammeke et al. | 166/105.5 |
| 5,431,228 | 7/1995 | Weingarten et al. | 166/357 |
| 5,450,901 | 9/1995 | Ellwood | 166/266 |
| 5,482,117 | 1/1996 | Kolpak et al. | 166/265 |
| 5,605,193 | 2/1997 | Bearden et al. | 166/370 |
| 5,730,871 | 3/1998 | Kennedy et al. | 210/512.2 |
| 5,794,697 | 8/1998 | Wolflick et al. | 166/265 |

FOREIGN PATENT DOCUMENTS

| | | | |
|---|---|---|---|
| 94/13930 | 6/1994 | WIPO | 166/265 |

OTHER PUBLICATIONS

U.S. application No. 09/028,624, Stevenson et al., filed Feb. 24, 1998.

U.S. application No. 09/056,272, Brady et al., filed Apr. 7, 1998.

U.S. application No. 09/158,391, Brady et al., filed Sep. 22, 1998.3

U.S. application No. 09/170,829, Brady et al., filed Oct. 13, 1998.

"New Design for Compact Liquid–Gas Partial Separation: Downhole and Surface Installations for Artificial Lift Applications" by J.S. Weingarten, M.M. Kolpak, S.A. Mattison and M.J. Williamson, 1995.

"Development and Testing of a Compact Liquid–Gas Auger Partial Separator for Downhole or Surface Applications" by J.S. Weingarten, M.M. Kolpak, S.A. Mattison and M.J. Williamson, Feb. 1997.

"Slim Phase 4™", Sperry–Sun Drilling Services, 1994, 1995.

"New Design Expands Success of Slim Phase 4™ MWD Resistivity Tool", Sperry Sun Drilling Services, Fall 1995.

"Improved Production Log Interpretation in Horizontal Wells Using Pulsed Neutron Logs", by J.L. Brady, J.J. Kohring and R.J. North, 1996.

"Glossary of Terms & Expressions Used in Well Logging", Second Edition, Society of Professional Well Log Analysis, Oct. 1984.

"Jet Pumping" by Hal Petrie, undated.

*Primary Examiner*—David Bagnell
*Assistant Examiner*—Sunil Singh
*Attorney, Agent, or Firm*—F. Lindsey Scott

[57] ABSTRACT

A method and system for increasing the production of hydrocarbons from a production well producing a mixture of hydrocarbons and water through a wellbore penetrating a formation having a production zone producing a mixture of hydrocarbons and water, and a selected injection zone, by separating, in the wellbore, at least a portion of the water from the mixture of hydrocarbons and water, to produce separated water and a hydrocarbon enriched mixture; injecting, by the use of a pump drivingly connected to a turbine, at least a major portion of the separated water into the selected injection zone; and recovering at least a major portion of the hydrocarbon enriched mixture.

16 Claims, 5 Drawing Sheets

METHOD AND SYSTEM FOR SEPARATING AND INJECTING WATER IN A WELLBORE

FIELD OF THE INVENTION

The invention relates generally to a method and a system for increasing the production of hydrocarbons from a wellbore penetrating a hydrocarbon bearing formation. More particularly, the invention relates to a method and system for increasing the production of hydrocarbons from a wellbore producing a mixture of hydrocarbons and water through a wellbore penetrating a formation containing an hydrocarbon bearing zone and a selected injection zone by separating and injecting a portion of the water into the injection zone prior to producing hydrocarbons from the wellbore to the surface.

BACKGROUND OF THE INVENTION

In many oil fields, the oil bearing formation comprises an oil bearing zone, a gas cap zone, and/or an aqueous zone. Many of these fields produce a mixture of hydrocarbons (e.g., oil and gas) and water wherein the ratio of the hydrocarbons to water decreases as the field ages. This is a result of many factors well known to those skilled in the art.

The produced stream of hydrocarbons and water is typically separated into an oil portion, a gas portion, and a water portion at the surface. The water portion may be disposed of in any desirable manner; for example, it may be treated and put into a surface water reservoir such as a pond, injected into the formation, or the like. The gas portion may be marketed as a natural gas product, injected into the gas cap to maintain pressure therein, or the like.

Water and gas are typically separated from the oil at the surface. During production of the stream of hydrocarbons and water through the wellbore, the water portion contributes significantly to the weight of the column of fluids in the wellbore, thereby significantly increasing the formation pressure required to produce the fluids without pumping. For fluids to be produced upwardly through the wellbore, the formation pressure must exceed the hydrostatic fluid pressure. As the formation ages, the formation pressure decreases until it is insufficient to overcome the hydrostatic fluid pressure and produce fluids from the formation to the surface without pumping or the like.

It is thus desirable to reduce the weight, and the consequent hydrostatic pressure, of the column of fluids in the wellbore and, thereby, increase the productive life of the subterranean formation so that greater quantities of oil may be produced at lower costs from a formation. This has been achieved by positioning a downhole separator and an electrically powered pump downhole in a wellbore. The separator is configured to separate at least a major portion of the water from the hydrocarbons, and the electrically powered pump then injects the water downhole into the formation so that the water is not produced with the hydrocarbons. It is, however, very expensive to install an electrically powered pump and, furthermore, such an electrically powered pump requires significant maintenance and, consequently, production must be periodically discontinued to maintain or replace the motor, resulting in increased costs, production down time, and lost revenues.

Accordingly, a continuing search has been directed to the development of a system and method in which water can be reliably separated and injected into the formation more economically than is possible with an electrically powered pump.

SUMMARY OF THE INVENTION

According to the present invention it has been found that increased quantities of oil can be reliably and economically produced from a production well producing a mixture of hydrocarbons and water through a wellbore penetrating a formation having a production zone producing a mixture of hydrocarbons and water, and a selected injection zone, by separating, in the wellbore, at least a portion of the water from the mixture of hydrocarbons and water, to produce separated water and a hydrocarbon enriched mixture; injecting, by the use of a pump drivingly connected to a turbine, at least a major portion of the separated water into the selected injection zone; and recovering at least a major portion of the hydrocarbon enriched mixture.

The present invention further comprises a reliable and economic system for increasing the production of hydrocarbons from a production well producing a mixture of hydrocarbons and water through a wellbore penetrating a formation having a production zone, wherein the system comprises a tubular member positioned in the wellbore; a separator positioned in the tubular member and in fluid communication with the production zone; a turbine positioned in the tubular member and in fluid communication with the separator to receive and be driven by separated hydrocarbons from the separator, and in fluid communication with hydrocarbon processing equipment at a surface for passing separated hydrocarbons to the processing equipment; a pump positioned in the tubular member and drivingly connected to the turbine, the pump having an inlet in fluid communication with the separator to receive separated water from the separator, and the pump having a discharge outlet to discharge separated water from the pump, and a discharge passageway in fluid communication with the discharge outlet from the pump and in fluid communication with the selected injection zone to pass separated water from the pump to the selection injection zone.

DESCRIPTION OF THE PREFERRED EMBODIMENTS

In the discussion of the Figures, the same numbers will be used to refer to the same or similar components throughout. In the interest of conciseness, not all components of the wells necessary for the operation of the wells have been discussed.

Figure 1:
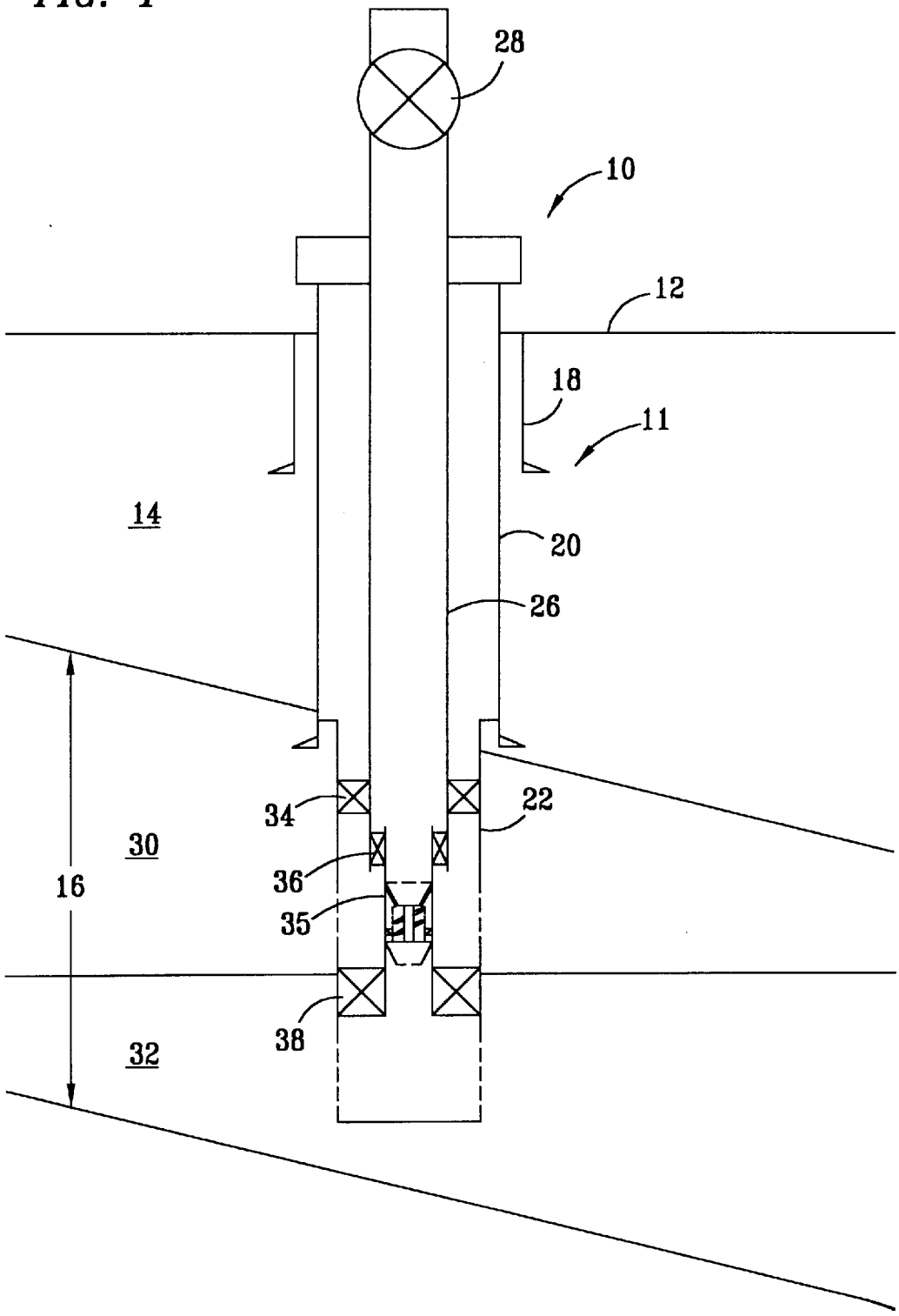
FIG. 1 is a schematic diagram of an embodiment of the system of the present invention positioned in an existing production well for producing hydrocarbons from a subterranean formation and for injecting water back into an aqueous zone below the formation.

In FIG. 1, a production well 10 includes a wellbore 11 positioned to extend from a surface 12 through an overburden 14 to a production zone 16 containing a mixture of hydrocarbons and water. The production well 10 further includes, extending into the wellbore, three casing sections, namely, a first casing section 18, a second casing section 20, and a third casing section 22, it being understood that the well 10 may, alternatively, include more or fewer than three casing sections. The use of such casing sections is well known to those skilled in the art for the completion of oil wells. The casings are of a decreasing size and the third casing section 22 may be a slotted liner, a perforated pipe, or the like. While the production well 10 is shown as a well which extends vertically into the formation 16, the well 10 may alternatively extend horizontally or at some other angle from vertical into the formation 16. Such variations are well known to those skilled in the art for the production of oil from subterranean formations.

The production well 10 also includes a production tubing 26 for the production of fluids from the wellbore 11. The production tubing 26 extends downwardly from a wellhead 28 shown schematically as a valve. The wellhead 28 contains the necessary valving and the like to control the flow of fluids into and from the well 10, the production tubing 26, and the like.

The formation 16 includes a hydrocarbon bearing zone 30 and an injection zone 32 below the hydrocarbon bearing zone 30. The zone 32 may be an aqueous zone, and may include hydrocarbons, and may even include a lower portion of the hydrocarbon bearing zone 30. Pressure in the formation 16 may be maintained by water and gas in the formation and, accordingly, it may be desirable in such fields to maintain the water and gas in the formation as oil is produced from the formation 16 by injecting water and/or gas produced from the formation back into the formation.

Figure 2:
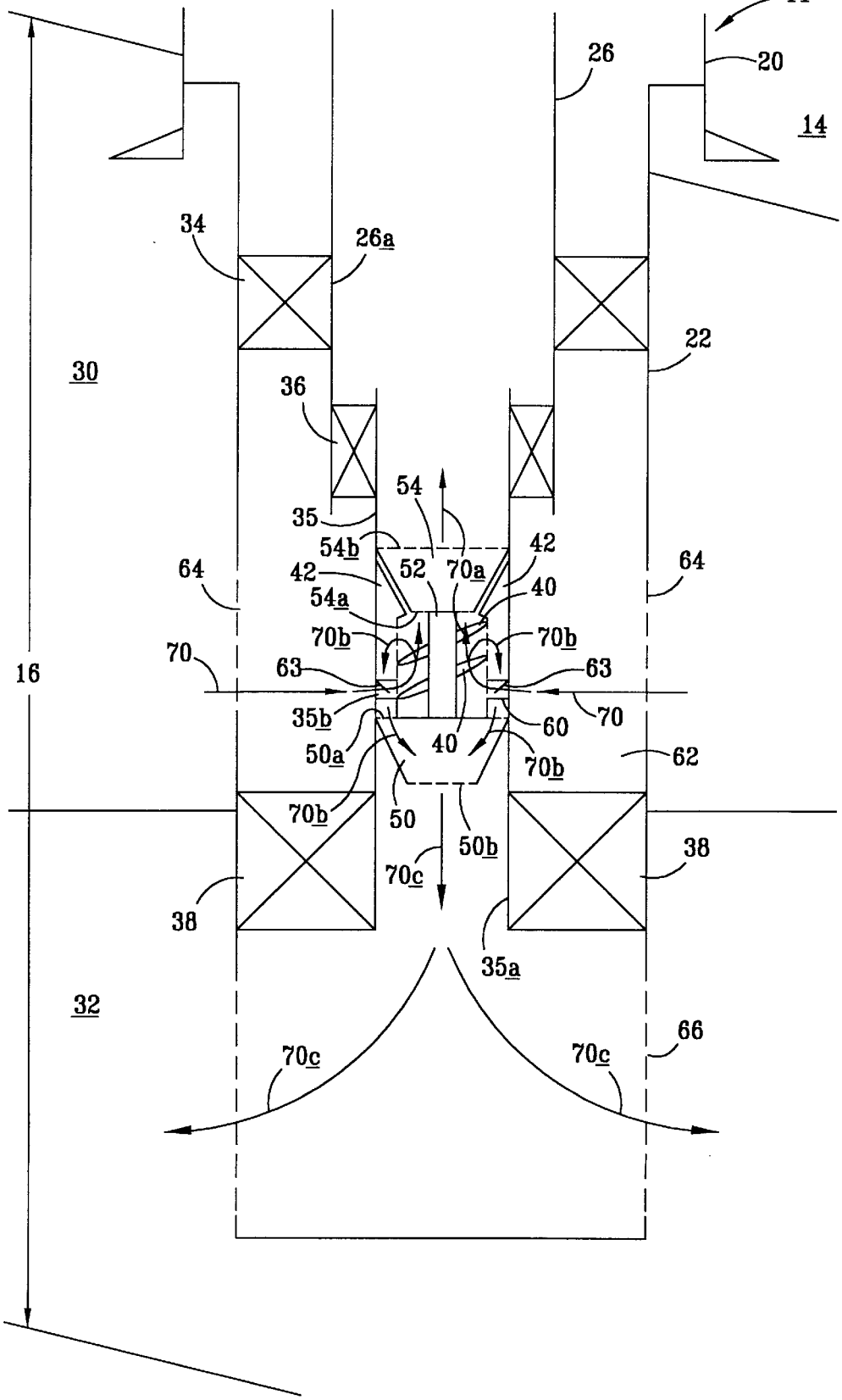
FIG. 2 is an enlargement of a portion of the schematic diagram of FIG. 1 depicting a turbine used for driving a pump, and including a separator positioned between the turbine and the pump.

FIG. 2 shows an enlargement of the lower portion of the well 10. As shown therein, a first packer 34 is positioned at a lower end 26*a* of the production tubing 26 to prevent the flow of fluids in the annular space above the packer 34 and between the exterior of the production tubing 26 and the interior of the third casing section 22. A tubular member 35, configured for supporting components of the present invention as discussed below, is positioned as known to those skilled in the art in the lower end 26*a* of the production tubing 26. The positioning of tubular members by wire line operations or coiled tubing is well known to those skilled in the art and will not be discussed. A second packer 36 or a nipple with a locking mandrel is positioned between the exterior of the tubular member 35 and the interior of the production tubing 26 to prevent the flow of fluids in the annular space between the tubular member 35 and the production tubing 26. A third packer 38 is positioned below the first and second packers 34 and 36, respectively, at a lower end 35*a* of the tubular member 35 between the exterior of the tubular member 35 and the interior of the third casing section 22 to control the flow of fluids in the annular space between the exterior of the tubular member 35 and that portion of the interior of the third casing section 22 below the first packer 34. Fluids from the formation 16 can thus flow upwardly through the production tubing 26 and the wellhead 28 to processing equipment at the surface. The well 10, as shown, produces fluids under formation pressure and does not require a pump.

The tubular member 35 includes, positioned therein, a downhole separator 40 such as an auger separator (depicted schematically in FIG. 2), a cyclone separator, a rotary centrifugal separator, or the like. Auger separators are more fully disclosed and discussed in U.S. Pat. No. 5,431,228, "Down Hole Gas Liquid Separator for Wells", issued Jul. 11, 1995 to Jean S. Weingarten et al, and in "New Design for Compact-Liquid Gas Partial Separation: Down Hole and Surface Installations for Artificial Lift Applications", Jean S. Weingarten et al, SPE 30637 presented Oct. 22–25, 1995, both of which references are hereby incorporated in their entirety by reference. Such separators are considered to be well known to those skilled in the art and are effective to separate at least a major portion of a heavier fluid, e.g., water, from lighter fluids, e.g., hydrocarbons, in a flowing stream of a mixture of such fluids by causing the fluid mixture to flow around a circular path thereby forcing the water to move radially outwardly by centrifugal force, and the hydrocarbons to be displaced and separated and to move radially inwardly within the separator.

An annular collector 42 is positioned between the exterior of the separator 40 and the interior of the tubular member 35 to collect water that is forced to the outside of the separator 40. The annular collector 42 is configured to direct collected water to a suitable pump 50 positioned within the tubular member 35 below the separator 40. The pump 50 includes an inlet 50*a* and an outlet 50*b* and may be any type of well known pump operable from rotation of a drive shaft 52 drivingly connected thereto, such as a centrifugal pump, a heli-coaxial pump, a positive displacement pump (e.g., a gear pump, a rotary lobe pump, a progressing cavity pump, or a reciprocating piston pump), or the like.

The pump 50 is drivingly connected through a drive shaft 52 to a suitable turbine 54, such as a turbine expander, a hydraulic turbine, a bi-phase turbine, or the like. Turbine expanders, hydraulic turbines, and bi-phase turbines are considered to be well known to those skilled in the art, and are effective for receiving a stream of fluids and generating from the stream of fluids torque exerted onto a shaft, such stream of fluids comprising largely gases, liquids, and mixtures of gases and liquids, respectively. Bi-phase turbines, in particular, are more fully disclosed and discussed in U.S. Pat. No. 5,385,446, entitled "Hybrid Two-Phase Turbine", issued Jan. 31, 1995, to Lance G. Hays, which reference is hereby incorporated in its entirety by reference. The turbine 54 includes an inlet 54*a* and an outlet 54*b* and is positioned above the pump 50 within the tubular member 35 for driving the pump 50 via the drive shaft 52. The turbine 54 is further configured so that hydrocarbons forced inwardly within the separator 40 are received under pressure from the separator to rotate the turbine, which then rotates the pump 50 through the shaft 52, to thereby pump collected water received into the pump 50 downwardly, as described below.

As shown in FIG. 2, a plurality of suitable passageways 60 (only two of which are depicted in FIG. 2) are provided which extend through the annular collector 42 and through a plurality of spaced openings 35*b* (only two of which are shown in FIG. 2) formed in the tubular member 35 between the separator 40 and a confined annular space 62 defined by the packers 34, 36, and 38 and the exterior of the tubular member 35 and the interior of the third casing section 22. Check valves 63 are optionally positioned over the openings 35*b* to prevent fluids from flowing from the separator 40 into the annular space 62. Perforations 64 are suitably formed in the casing 22 for providing fluid communication between the annular space 62 and the hydrocarbon zone 30; and perforations 66 are suitably formed in the casing 22 for providing fluid communication between the bottom interior of the casing 22 and the aqueous zone 32.

In the operation of the device shown in FIGS. 1 and 2, a mixture of hydrocarbons and water flows, as shown schematically by the arrow 70, from the hydrocarbon bearing zone 30 of the formation 16 through the perforations 64 in the casing 22 and the passageways 60 into the separator 40. The mixture then flows through the separator 40 in a circular path around the shaft 52 until the water moves under centrifugal force toward the annular collector 42, and the hydrocarbons are displaced toward the shaft 52. As shown schematically by arrows 70*a,* the separated hydrocarbons then flow upwardly and enter into the inlet 54*a* of the turbine 54 and cause the turbine to rotate. The hydrocarbons then exit through the outlet 54*b* of the turbine 54 and flow upwardly through the tubular member 35 and the production tubing 26 for processing at the surface 12 (FIG. 1) using conventional facilities (not shown). As the turbine 54 rotates, the shaft 52 rotates and drives the pump 50. As shown schematically by an arrow 70*b,* the separated water flows into the annular collector 42 and downwardly through the inlet 50*a* into the pump 50 where the water is pumped into the aqueous zone 32 with a pressure exceeding the pressure of the water in the aqueous zone. As shown schematically by an arrow 70*c,* the water then flows out through the outlet 50*b* through the perforations 66 in the casing section 22 and into the aqueous zone 32.

Figure 3:
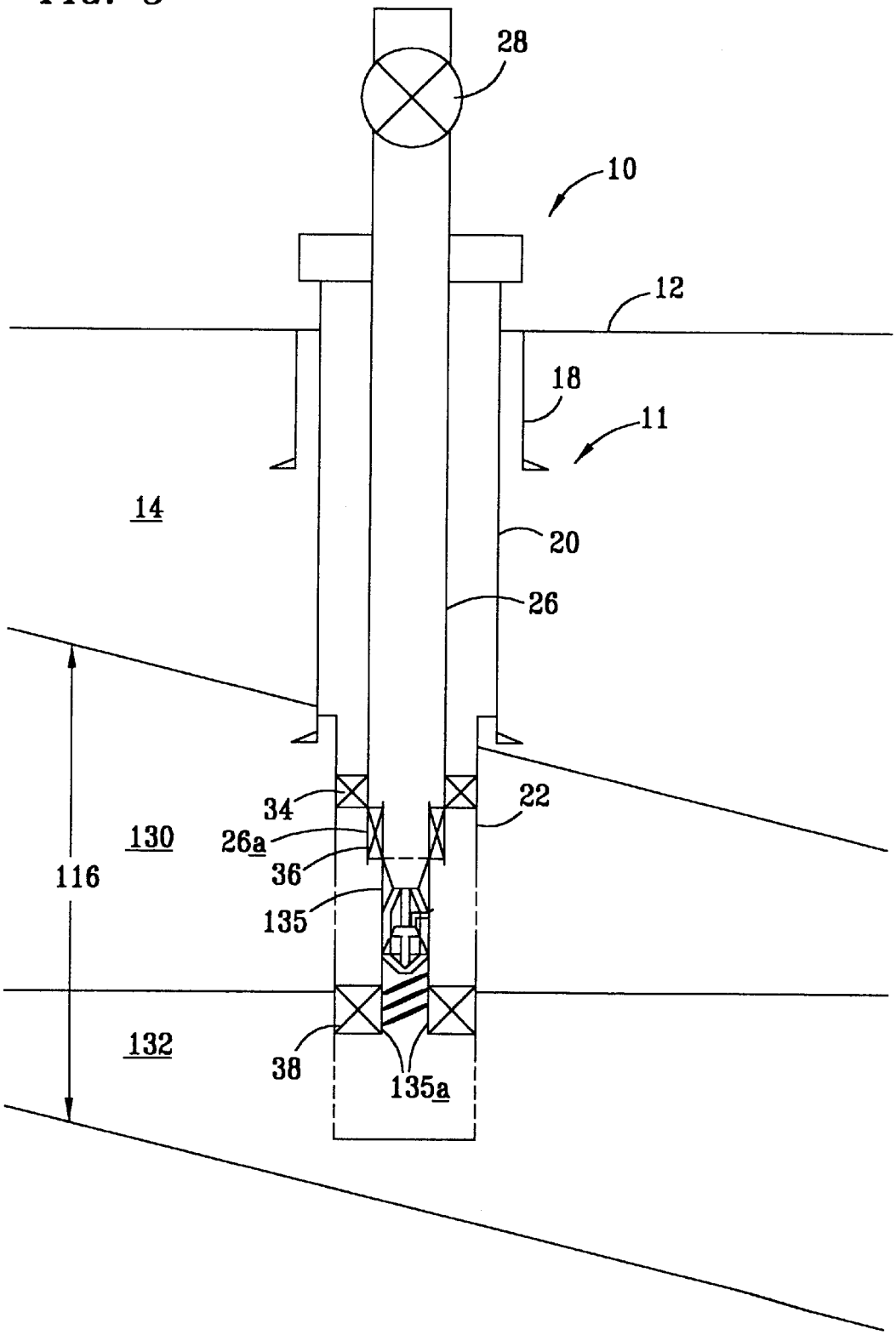
FIG. 3 is a schematic diagram of an alternate embodiment of the system of the present invention.
Figure 4:
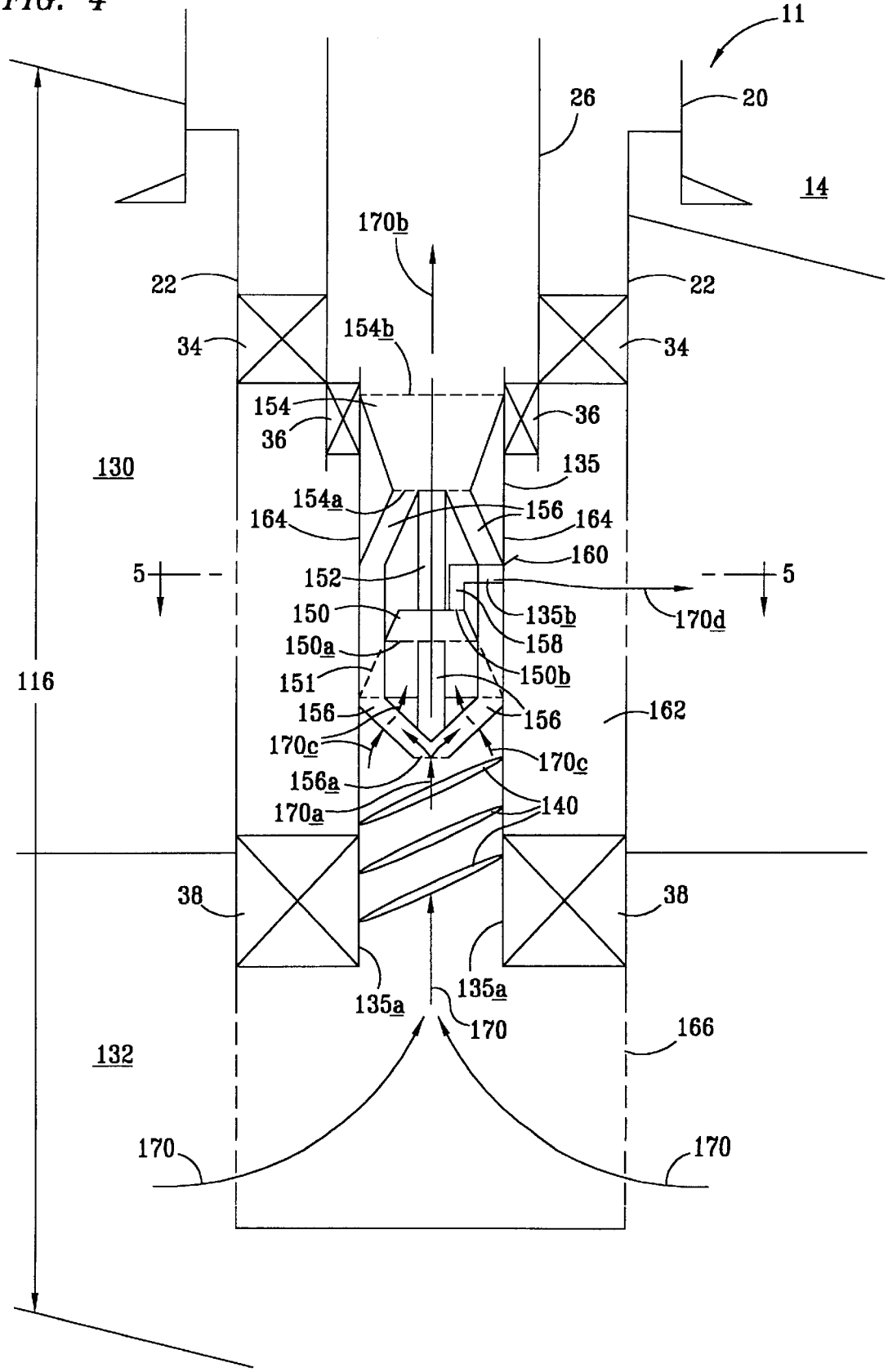
FIG. 4 is an enlargement of a portion of the schematic diagram of FIG. 3 depicting a turbine used for driving a pump, and including a separator positioned below the turbine and the pump.
Figure 5:
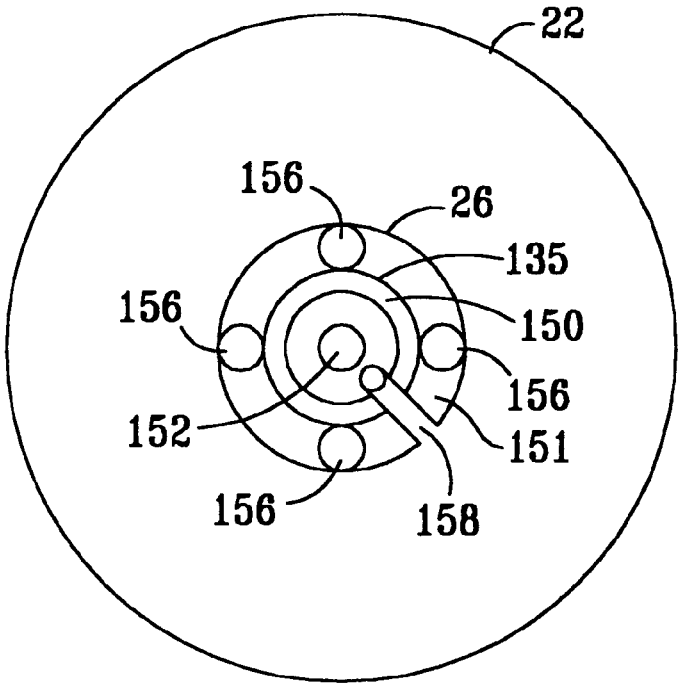
FIG. 5 is a schematic diagram of a cross section of the system of FIG. 4 taken along the line 5—5 of FIG. 4.

In FIGS. 3–5,an alternate embodiment of the system of FIGS. 1–2 is shown, and the same or similar components are given the same reference numerals. According to the embodiment of FIG. 3, the production well 10 includes the wellbore 11 positioned to extend from the surface 12 through the overburden 14 to a hydrocarbon and water bearing formation 116. The production well 10 further includes, extending into the wellbore 11, the first casing section 18, the second casing section 20, and the third casing section 22, which casings are of a decreasing size and the third casing section 22 may be a slotted liner, a perforated pipe, or the like, as described above. The well 10 also includes the production tubing 26 which extends downwardly from the wellhead 28, a tubular member 135, similar to the tubular member 35, positioned in a lower end 26*a* of the production tubing 26, and the first, second, and third packers 34, 36, and 38, respectively, which are positioned as described above. A separator and pump according to the second embodiment of the present invention are positioned in the tubular member 135 as described in greater detail below with respect to FIG. 4.

The formation 116 includes an injection zone 130 and a hydrocarbon bearing zone 132 below the injection zone. The zone 130 is may be a gas cap zone, an overlying aqueous zone, or even an upper portion of the hydrocarbon bearing zone 132 and include hydrocarbons. Pressure in the formation 116 may be maintained by water and gas in the formation and, accordingly, it is desirable in such fields to maintain the water and gas in the formation as hydrocarbons are produced from the formation 116 by injecting water or gas produced from the formation back into the formation.

FIG. 4 shows an enlargement of the tubular member 135. As schematically shown therein, the tubular member 135 includes a downhole separator 140, such as an auger separator, a cyclone separator, a rotary centrifugal separator, or the like, positioned therein, which separator 140 is similar to the separator 40 described above.

A suitable pump 150, similar to the pump 50, having an inlet 150*a* and an outlet 150*b,* is positioned above the separator 140 within the tubular member 135, and includes a skirt 151 extending downwardly and outwardly to the tubular member 135. The pump 150 may comprise a centrifugal pump, a positive displacement pump (e.g., a reciprocating piston pump), or the like, and is drivingly connected through a drive shaft 152 to a suitable turbine 154, similar to the turbine 54 described above. The turbine 154 includes an inlet 154*a* and an outlet 154*b* and is positioned above the pump 150 within the tubular member 135 for driving the pump 150 via the drive shaft 152. A plurality of spaced conduits 156, such as four conduits (only three of which are shown in FIG. 4), are arranged within the tubular member 135 with a common opening 156*a* centrally positioned above the separator 140 for receiving hydrocarbons from the separator 140 and for directing the flow of the received hydrocarbons through the skirt 151 and around the pump 150 to the turbine 154, to thereby rotate the turbine 154 which then rotates the pump 150 through the shaft 152, as described below.

The pump 150 is provided with a discharge outlet 158 which extends from the outlet 150*b* through a suitable opening 135*b* formed in the tubular member 135, and into a confined annular space 162 defined between the packers 34, 36, and 38, and the exterior of the tubular member 135, and the interior of the third casing section 22. A check valve 160 may optionally be positioned over the opening 136*b* to prevent the backflow of fluids from the zone 130 to the pump 150. Perforations 164 are suitably formed in the casing 22 for providing fluid communication between the annular space 162 and the overlying zone 130, and perforations 166 are suitably formed in the casing 22 for providing fluid communications between the bottom interior of the casing 22 and the hydrocarbon zone 132.

FIG. 5 shows a plan view of the foregoing system of FIG. 4 taken along the line 5—5 of FIG. 4 and, in particular, depicts the arrangement of the four conduits 156 therein. While the conduits 156 are depicted therein as having circular cross-sections, it is understood that they may comprise other cross-sectional shapes such as, for example, an elongated oval shape configured to fit within the annual space between the pump 150 and the production tubing 26. It is also understood that more or less than four conduits 156 may be utilized.

In the operation of the system shown in FIG. 3–5, a mixture of hydrocarbons and water flows, as shown schematically by the arrows 170, from the hydrocarbon and water bearing zone 132 of the formation 116 through the perforations 166 of the casing 22 and into the separator 140. The mixture then flows through the separator 140 in a circular path until the water moves under centrifugal force toward the tubular member 135, and the hydrocarbons are displaced inwardly away from the tubular member 135. As shown schematically by an arrow 170*a,* the separated hydrocarbons then flow upwardly and enter into the opening 156*a* and flow through the conduits 156 and enter through the inlet 154*a* into the turbine 154 and cause the turbine 154 to rotate. The hydrocarbons then exit through the outlet 154*b* of the turbine 154, as indicated by the arrow 170*b,* and flow upwardly through the production tubing 26 for processing at the surface 12 (FIG. 3) using conventional processing facilities (not shown). As shown schematically by an arrow 170*c,* the separated water flows from the separator 140 through the inlet 150*a* into the pump 150. The shaft 152 connecting the turbine 154 to the pump 150 drives the pump 150 to pump water received from the separator 140 through the pump outlet 150*b* and, as further shown schematically by the arrow 170*d,* through the discharge outlet 158, the opening 135*b,* the check valve 160, the annular space 162, and the perforations 164 into the gas cap zone 130 with a pressure exceeding the pressure of the gas in the gas cap zone.

It is understood that the present invention can take many forms and embodiments. Accordingly, several variations may be made in the foregoing without departing from the spirit or the scope of the invention. For example, in an alternative embodiment of the present invention, the turbines 54 and 154 may be driven with gas supplied from sources in lieu of or in addition to gas supplied from the formation, such as from a gas lift mandrel, coiled tubing, or the like, which are well known in the art and will not be described in detail. In another variation, the pump 50 or 150 may be provided with a gear box or planetary gear arrangement to reduce the rotational speed of the shaft 52 or 152, and increase the torque, driving the respective pump. In still another variation, the invention may be practiced without using the tubular member 135 and the second packer 36 by extending the production tubing 26 to the packer 38, and then positioning the separator, turbine, and pump in the lower portion of the production tubing 26.

By the use of the foregoing systems depicted in FIGS. 1–5, a portion of the water is removed from the mixture of hydrocarbons and water produced from the formation 116 and injected downhole without the necessity for an electric pump, or for separating the water using surface processing equipment and then injecting separated water downhole. The use of the turbines 54 and 154 permit formation pressure to be used to drive the pumps 50 and 150 rather than an electrically powered motor, thereby decreasing the cost of the water injection process. Furthermore, the removal of a significant portion of the water downhole relieves the load on the surface processing equipment since a smaller volume of water is produced to the surface. The downhole removal and injection of water also reduces the water content of the mixture of hydrocarbons and water produced to the surface, and also significantly reduces the formation pressure required to produce the mixture to the surface, and thus increases the amount of oil which can be recovered from a formation using formation pressure. Additionally, between the two foregoing embodiments, water may be received from the hydrocarbon bearing zone of a formation and injected into another zone located either above or below the hydrocarbon bearing zone.

The investment to install the system of the present invention in a plurality of wells to reduce the water produced from a field is substantially less than the cost of adding the additional separation and injection equipment at the surface. It also permits the injection of selected quantities of water into the gas cap or into an aqueous zone downhole from groups of wells, or individual wells from which oil production has become limited by reason of the capacity of the well tubing, surface pipelines, or flow lines to convey produced fluids away from the well thereby permitting increased production from such wells. Because the present invention permits water to be injected downhole, a hydrocarbon enriched mixture of hydrocarbons and water may be produced to the surface.

It is also considered that the system of the present invention can be readily designed, assembled, and installed by techniques well known to those skilled in the art.

The present invention has thus provided a method and a system for recovering additional hydrocarbons from a formation, which produces a mixture of hydrocarbons and water, at a greatly reduced cost and enhanced reliability by comparison to the previously used methods and equipment.

Having thus described the invention by reference to certain of its preferred embodiments it is noted that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

Having thus described the invention, what is claimed is:

1. A method for increasing the production of hydrocarbons from a production well producing mixture of hydrocarbons comprising a mixture of liquids and gases, and water through a wellbore penetrating a formation having a production zone producing a mixture of hydrocarbons and water, and a selected injection zone, the method comprising the steps of:

a) separating, in the wellbore with an auger separator, at least a portion of the water from the mixture of hydrocarbons and water, to produce separated water and a hydrocarbon enriched mixture;

b) injecting, by the use of a pump drivingly connected via a drive shaft to a turbine driven by the hydrocarbon enriched mixture, at least a major portion of the separated water into the selected injection zone; and c) recovering at least a major portion of the hydrocarbon enriched mixture.

2. The method of claim 1 wherein the step of injecting comprises injecting, by the use of the pump drivingly connected to the turbine, at least a major portion of the separated water into an injection zone selected from one of a gas cap zone, an aqueous zone, an oil bearing zone, and the production zone.

3. The method of claim 1 wherein the step of injecting includes the step of increasing the pressure of the separated water to a pressure greater than the pressure in the selected injection zone.

4. The method of claim 1 wherein the step of injecting includes the step of pumping the separated water into the selected injection zone.

5. The method of claim 1 wherein the step of separating is performed in a tubular member in the wellbore, the tubular member being in fluid communication with the formation and with a surface.

6. The method of claim 5 wherein the step of injecting includes driving the turbine with the hydrocarbon enriched mixture, the turbine being positioned in the tubular member and connected to the pump for performing the step of injecting, the turbine being selected from a group consisting of a turbine expander, a hydraulic turbine, and a bi-phase turbine.

7. The method of claim 1 wherein the step of injecting includes driving the turbine with fluid received through one of a gas lift mandrel and a coiled tubing.

8. The method of claim 1 wherein the step of separating includes receiving the mixture of hydrocarbon and water from the production zone.

9. A system for increasing the production of hydrocarbons from a production well producing a mixture of hydrocarbons, comprising a mixture of liquids and gases, and water through a wellbore penetrating a formation having a production zone producing a mixture of hydrocarbons and water, and a selected injection zone, the system comprising:

a) a tubular member positioned in the wellbore;

b) an auger separator positioned in the tubular member and in fluid communication with the production zone;

c) a turbine positioned in the tubular member and in fluid communication with the auger separator to receive and be driven by separated hydrocarbons from the auger separator, and in fluid communication with hydrocarbon processing equipment at a surface for passing separated hydrocarbons to the processing equipment;

d) a pump positioned in the tubular member and drivingly connected via a drive shaft to the turbine, the pump having an inlet in fluid communication with the auger separator to receive separated water from the auger separator, and the pump having a discharge outlet to discharge separated water from the pump; and e) a discharge passageway in fluid communication with the discharge outlet from the pump and in fluid communication with the selected injection zone to pass separated water from the pump to the selected injection zone.

10. The system of claim 9 wherein the outlet through the wall of the tubular member comprises a check valve to prevent the flow of hydrocarbons and water from the formation into the pump through the discharge passageway.

11. The system of claim 9 wherein the tubular member is positioned in a lower end of a tubing string extending to the surface.

12. The system of claim 9 further comprising an annular collector positioned above the pump and below the turbine, the annular collector having at least one passageway configured for receiving the flow of hydrocarbons and water therethrough, wherein the auger separator is positioned within the annular collector for receiving the flow of hydrocarbons and water through the passageway from the production zone, and wherein the annular collector is configured for receiving at least a portion of the separated water from the auger separator and directing the received separated water to the pump.

13. The system of claim 9 wherein the pump is selected from a group of pumps consisting of a positive displacement pump and a centrifugal pump.

14. The system of claim 9 wherein the turbine is selected from a group consisting of a turbine expander, a hydraulic turbine, and a bi-phase turbine.

15. The system of claim 9 wherein the selected injection zone is one of a gas cap zone, an aqueous zone, an oil bearing zone, and the production zone.

16. The system of claim 9 further comprising one of a gas lift mandrel and coiled tubing in fluid communication with the turbine to supply fluid to drive the turbine.

* * * * *